US006684747B2

(12) United States Patent
Aichele

(10) Patent No.: US 6,684,747 B2
(45) Date of Patent: Feb. 3, 2004

(54) CUTTING MACHINE, CUTTING TOOL AND ANVIL ROLLER

(75) Inventor: Wilhelm Aichele, Crailsheim (DE)

(73) Assignee: Aichele Werkzeuge GmbH, Crailsheim (DE)

( * ) Notice: Subject to any disclaimer, the term of this patent is extended or adjusted under 35 U.S.C. 154(b) by 0 days.

(21) Appl. No.: 09/930,571

(22) Filed: Aug. 15, 2001

(65) Prior Publication Data

US 2002/0020270 A1 Feb. 21, 2002

(30) Foreign Application Priority Data

Aug. 16, 2000 (DE) ..... 100 40 024

(51) Int. Cl.[7] ..... D26D 1/40
(52) U.S. Cl. ..... 83/344; 83/506
(58) Field of Search ..... 83/602, 582, 583, 83/611, 698, 503, 501, 348, 344, 505, 506, 347

(56) References Cited

U.S. PATENT DOCUMENTS 4,770,078 A * 9/1988 Gautier ..... 83/344
5,367,936 A * 11/1994 Held et al. ..... 83/698.61

FOREIGN PATENT DOCUMENTS

| | | |
|---|---|---|
| DE | 29 31 109 | 2/1981 |
| DE | 297 15 037 | 11/1997 |
| WO | WO 91/17027 | 11/1991 |
| WO | 198 34 104 | 2/2000 |

* cited by examiner

*Primary Examiner*—Allan N. Shoap
*Assistant Examiner*—Ghassem Alie
(74) *Attorney, Agent, or Firm*—Barry R. Lipsitz; Douglas M. McAllister

(57) ABSTRACT

A cutting machine includes an anvil roller rotatable on a machine frame about an axis of rotation. The anvil roller has an anvil surface. A cutting tool is mounted on the machine frame for rotation about an axis of rotation, with a cutter interacting with the anvil surface and with supporting rings which are held on the cutting tool and support it relative to the anvil roller with their supporting ring surfaces and/or vice versa. The quality of the cutting effect can be maintained even when the cutter becomes worn, by enabling the diameter of the supporting ring surface of each supporting ring to be adjustable by radial expansion and contraction.

20 Claims, 7 Drawing Sheets

CUTTING MACHINE, CUTTING TOOL AND ANVIL ROLLER

The present disclosure relates to the subject matter disclosed in German application No. 100 40 024.8 of Aug. 16, 2000, which is incorporated herein by reference in its entirety and for all purposes.

BACKGROUND OF THE INVENTION

The invention relates to a cutting machine comprising a machine frame, an anvil roller rotatably mounted on the machine frame about a rotary axis and having an anvil surface, a cutting tool mounted on the machine frame for rotation about a rotary axis, with a cutter interacting with the anvil surface and with supporting rings which are held on the cutting tool and support it relative to the anvil roller with their supporting ring surfaces and/or vice versa.

A cutting machine of this type is known e.g. from German patent application 198 34 104.0.

The problem with such cutting machines is that the cutter itself wears down in the course of time, and even slight wear on it may lead to an inadequate cutting effect with sensitive webs of material.

The object underlying the invention is therefore to improve a cutting machine of the generic type so that the quality of the cutting effect can be maintained even when the cutter becomes worn.

SUMMARY OF THE INVENTION

In a cutting machine of the above type this object is solved, according to the invention, in that the diameter of the surface of each supporting ring is adjustable by radial stretching of the supporting ring within the range below an elastic expansion limit of its material by means of an expansion device.

The advantage of the solution according to the invention is thus that the possibility has been created of making the diameter of the supporting ring surfaces variable, as a means of allowing for changes in the radial extent of the cutter and particularly for wear on it.

In the solution according to the invention, initially with a new, i.e. unworn cutter, the supporting ring is stretched to the maximum, though still within the range below its elastic expansion limit, so that the supporting ring surface has its maximum diameter. When the cutter becomes worn the expansion can be reduced by the adjustable expansion device; as the stretch is within the range below the elastic expansion limit of the supporting ring, that ring contracts automatically through its elastic action when the expansion device is reset to less expansion, and the diameter of the supporting ring surface can thus be reduced according to the wear on the cutter.

The solution according to the invention may therefore have the expansible supporting rings according to the invention on the cutting tool or on the anvil roller or on both; in the latter case a supporting ring on the cutting tool and a corresponding supporting ring on the anvil roller will have their surfaces in contact, so that twice the adjustment range can be obtained.

The expansion device might for example operate hydraulically, comprising e.g. hydraulically actuated clamping jaws. A particularly favorable solution is for the device to have interacting wedge surfaces which are adjustable in their position relative to each other, in order to expand the supporting ring adjustably.

The wedge surfaces might e.g. be simple (flat) surfaces, in which case the supporting ring could be stretched (i.e., expanded) evenly by a plurality of wedge surfaces.

A particularly favorable solution provides for at least one of the wedge surfaces to be in the form of a conical surface relative to the rotary axis. A conical surface of this type allows particularly uniform expansion of the supporting ring.

However it is particularly beneficial for both wedge surfaces to be in the form of conical surfaces relative to the rotary axis, in order to expand the supporting ring as evenly as possible and especially to obtain uniform radial rigidity for the support between the cutting tool and anvil roller.

In a particularly favorable solution in respect of adjustability, one the wedge surfaces is an internal one and the other is a corresponding external one, and they are movable relative to each other in a direction parallel with the rotary axis to adjust the expansion of the supporting ring.

A particularly appropriate way of adjusting the expansion with the expansion device is for an internal wedge surface to be arranged on a radially expansible element carrying it; that element allows the supporting ring to be supported radially in a simple manner.

A particularly appropriate solution provides that, in all diameter adjustments of the supporting ring surfaces the internal wedge surface is seated on the external wedge surface with elastic expansion of the element carrying the internal surface, so that the expansion device operating with the wedge surfaces does not allow any play or radially reduced rigidity through the superimposed wedge surfaces, which would have a negative effect on the support between the cutting tool and the anvil roller.

In an advantageous embodiment the external wedge surface is provided on an expansion member arranged on the cutting tool or the anvil roller; this expansion member may be either part of the cutting tool or the anvil roller or may be a separate part placed on and supported against the cutting tool or anvil roller.

The expansion member could itself have a certain radial elasticity. In order to obtain defined expansion of the supporting ring it is however advantageous for the expansion member to be substantially non-elastic in a radial direction.

Particularly simple adjustment of radial expansion can be obtained if the radially expansible element carrying the internal wedge surface and the expansion member are movable relative to each other in the direction of the rotary axis, so that the required amount of expansion can be set.

It is particularly beneficial if the radially expansible element carrying the internal wedge surface and the expansion member may be fixed in the various positions relative to each other on the cutting tool or on the anvil roller.

Especially simple adjustability can be obtained if the radially expansible element and the expansion member may be positioned varying distances away from an end face of the cutting tool or the anvil roller, in order to hold these in the required position relative to each other which predetermines the expansion.

This can be engineered particularly appropriately if the radially expansible element or the expansion member may be positioned by a distance element different distances away from the end face of the cutting tool or on the anvil roller, so that the necessary relative positioning of the expansion member and radially expansible element can be defined in a simple manner.

It would be possible to construct the expansion device with an expansion member and a radially expansible element provided, these parts then interacting to expand the supporting ring in a radial direction.

A structurally particularly simple and hence cost-effective solution is for the radially expansible element to be the supporting ring itself, so that the supporting ring itself is part of the expansion device provided that the ring carries the internal wedge surface.

In a structurally especially simple embodiment the external wedge surface is seated on a central expansion member which is surrounded by the supporting ring.

To obtain easy adjustability of the expansion but also stable fixing of the supporting ring on the cutting tool, the supporting ring may be braced against an end face of the cutting tool or of the anvil roller, in order not only to brace the supporting ring in a radial direction but also to put it in a defined position in a plane perpendicular to the rotary axis, thus achieving extremely precise bracing of the cutting tool and anvil roller relative to each other.

The solution according to the invention can be obtained particularly easily if the supporting ring can be positioned against the cutting tool an adjustable distance away from the end face of the cutting tool or anvil roller according to the elastic expansion state.

It is particularly appropriate if the supporting ring can be positioned various distances away from the end face by the distance element, as clamping is then still possible, enabling the supporting ring to be held securely to the cutting tool or anvil roller.

In addition the above-mentioned object can be solved according to the invention by a cutting tool rotatable about a rotary axis, with a cutter which interacts with an anvil surface of an anvil roller rotatable about a rotary axis, and with supporting rings which are held to the cutting tool and support it relative to the anvil roller with their supporting ring surfaces, in that in the case of each supporting ring the diameter of the supporting ring surface is adjustable by radial expansion of the supporting ring within the range below an elastic expansion limit of its material, by means of an expansion device.

The above-mentioned object can further be solved according to the invention by an anvil roller rotatable about a rotary axis, comprising an anvil surface which interacts with a cutter of a cutting tool rotatable about a rotary axis, and further comprising supporting rings which are held to the anvil roller and support it relative to the cutting tool with their supporting ring surfaces, in that in the case of each supporting ring the diameter of the supporting ring surface is adjustable by radial expansion of the supporting ring within the range below an elastic expansion limit of its material, by means of an expansion device. Other features and advantages of the invention are the subject of the following description and of the drawings of an embodiment.

DETAILED DESCRIPTION OF THE INVENTION

Figure 1:
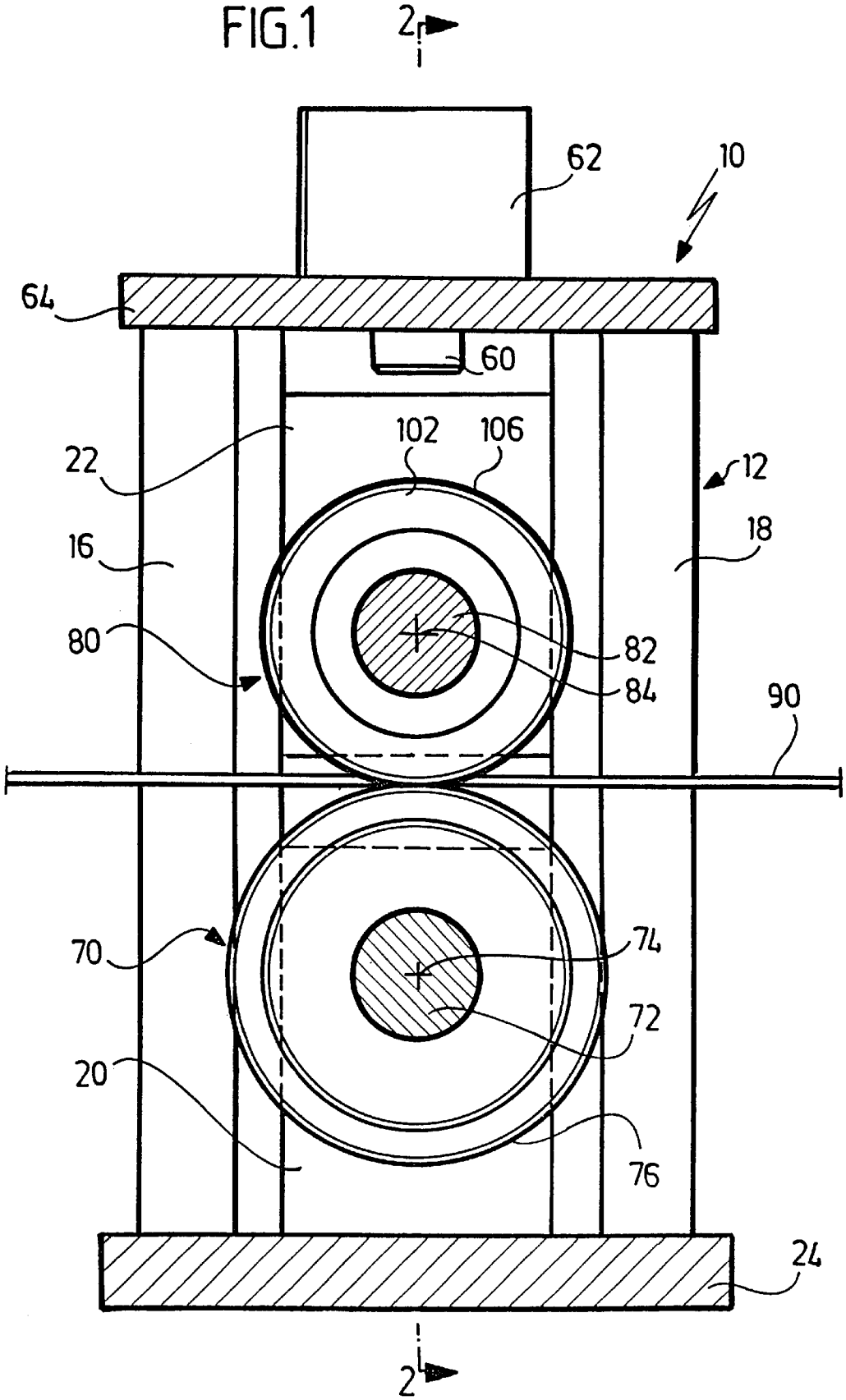
FIG. 1 is a vertical section through a cutting machine according to the invention taken along line 1—1 in FIG. 2.
Figure 2:
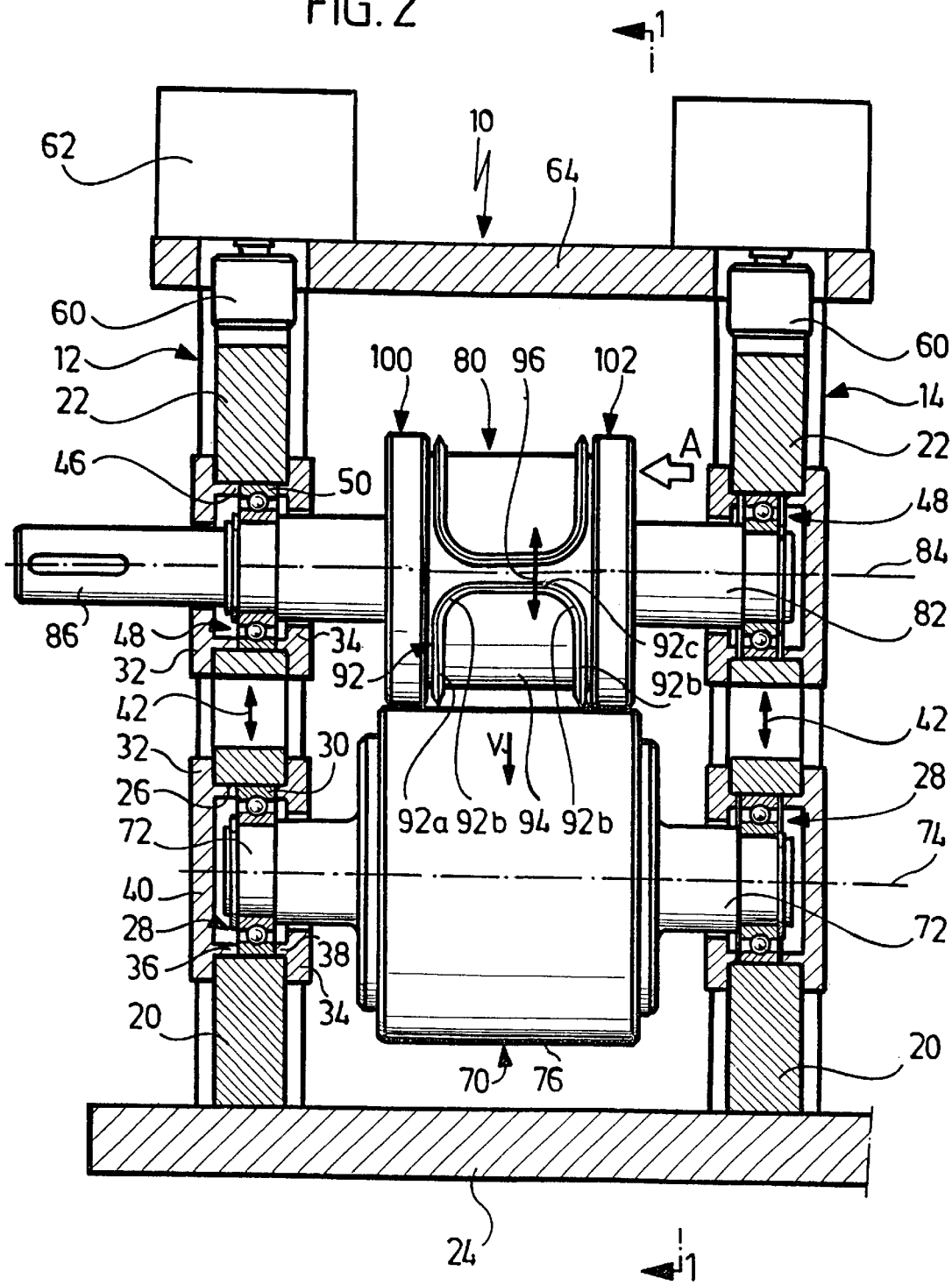
FIG. 2 is a vertical section taken along line 2—2 in FIG. 1.

A cutting machine according to the invention, shown in respective sections in FIGS. 1 and 2, comprises a machine frame referred to generally as 10 and having two spaced bearing members 12 and 14.

Each bearing member, e.g. member 12 in FIG. 1, comprises two side mounts 16 and 18 with a lower bearing mount 20 and an upper bearing mount 22 arranged between them.

The lower bearing mount 20 is on the one hand located between the side mounts 16 and 18 and on the other hand seated securely on a base plate 24 of the machine frame 10. The mount 20 has a bearing receiver 26 in which the outer race 30 of a lower pivot bearing referred to generally as 28 is inserted, the outer peripheral side of the race 30 lying against an internal surface of the receiver 26. The race 30 is fixed in the receiver 26 by an external retaining member 32 and an internal retaining member 34; these have retaining rings 36 and 38 which lie against lateral annular surfaces of the external race 30 and thus fix it in the receiver 26. In addition the external retaining member 32 has a cover 40.

The upper bearing mount 22 is located between the side mounts 16 and 18 and arranged displaceably in a direction 42 parallel with that in which the mounts 16 and 18 extend, in the direction of the lower bearing mount 20. The upper mount 22 also has a bearing receiver 46 in which an upper pivot bearing 48 is inserted.

The outer race 50 of the upper pivot bearing 48 is held in and against the bearing receiver 46 in the same way as the outer race 30 of the lower pivot bearing 28, and an external retaining member 32 and an internal retaining member 34 are also provided; these are in the same form as the retaining members provided in the lower bearing mount 20, and they fix the outer race 50 of the upper bearing 48 in the same way.

The upper bearing mount 22 is itself supported by a biasing means referred to generally as 60, against an abutment 62 which is held on an upper plate 64 extending parallel with the base plate 24; the upper plate 64 also connects the bearing members 12 and 14 and fixes the side mounts 16 and 18 relative to each other.

Bearing member 14 is in the same form as bearing member 12.

A shaft stub 72 is mounted in each of the two lower pivot bearings 28; the stubs 72 project laterally from an anvil roller referred to generally as 70 and are arranged concentrically with a rotary axis 74 of the roller 70, which has a larger radius than the shaft stub 72 and is provided with a circular cylindrical anvil surface 76 arranged coaxially with the axis 74.

The two lower pivot bearings 28 thus support the anvil roller 70 securely in the lower bearing mounts 20, which in turn rest on the base plate 24 and are located between the side mounts 16 and 18.

In the upper pivot bearings 48 of the upper bearing mount 22 a cutting tool 80 which is driven in rotation and which has a tool shaft 82 is mounted for rotation about an axis 84; the tool shaft 82 for example extends through the bearing member 12 and has a drive stub 86 projecting beyond the member 12 at the side opposite its rotating cutting tool 80; the stub 86 provides a rotary drive for the rotating cutting tool 80 by means of a drive, e.g. a motor.

The rotating cutting tool 80 is movable in the direction of the anvil roller 70 owing to the arrangement of the upper pivot bearings 48 in the upper bearing mounts 22 and their displaceability in direction 42. With the aid of the biasing means 60 which act on the upper bearing mounts 22 the rotating cutting tool 80 may be biased in the direction of the anvil roller 70, in such a way that the tool as an entity acts on the roller 70 with a biasing force V.

The rotating cutting tool 80 has cutters 92 for severing a web 90 of material, referred to generally as 90 and passed through between the rotating tool 80 and the anvil roller 70; the cutters 92 project from a base which is e.g. cylindrical of the rotary axis 84, radially of the rotary axis 84 and extending constantly radially of that axis. The cutter 92 may for example comprise two limbs 92*a* extending in an azimuthal direction relative to the rotary axis 84 and merging into cutter curves 92*b* extending transversely thereof, the cutter curves 92*b* then being joined by a transverse cutter 92*c* running approximately perpendicular to the azimuthal direction 96 and thus approximately parallel with the rotary axis 84 (FIG. 3).

Figure 3:
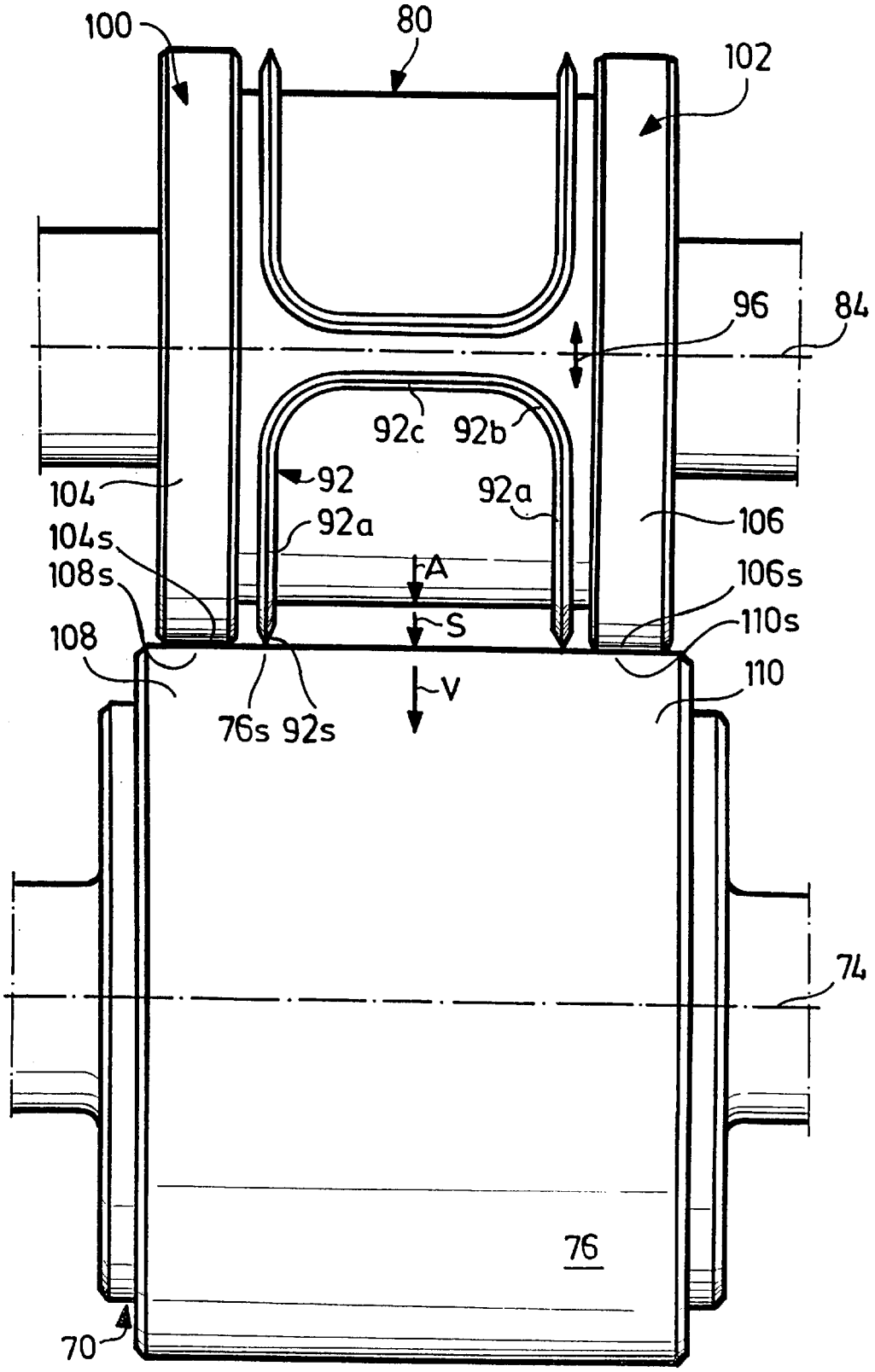
FIG. 3 is a larger-scale representation of the anvil roller and cutting tool in FIG. 2.

The cutter 92 may for example have two transverse cutters 92*c*, from which the curves 92*b* extend in opposite directions and then merge into the limbs 92*a*, which link the curves 92*b* located at each side of the transverse cutters 92*c* as shown on a larger scale in FIG. 3.

The cutting action of the cutter 92 takes place as shown in FIG. 3, through the combined action of an effective section of cutter 92*s* located the most minimal distance opposite or almost touching a corresponding section of anvil surface 76*s*; rotation of the rotating cutting tool 80 and co-rotation of the anvil roller 70 cause successive sections of cutter 92*s* and anvil surface 76*s* to be in their effective position and cooperate in cutting.

In order to define a short distance between the cooperating cutter sections 92*s* and anvil surface sections 76*s* or so-called slight contact between them, the rotating cutting tool 80 is provided with two supporting rings 100 and 102 which are non-rotatably connected; the rings may for example be arranged on both sides of the cutter 92 coaxially with the rotary axis 84 and may have respective surfaces 104 and 106 arranged e.g. cylindrically of the axis 84 and lying on supporting surfaces 108 and 110 of the anvil roller 70, the supporting surfaces 108 and 110 possibly being formed e.g. by parts of the anvil surface 76.

Support is provided by supporting ring sections 104*s* and 106*s* seated on corresponding sections 108*s* and 100*s* of supporting surfaces 108 and 110; when the rotating tool 80 is turned successive supporting ring sections 104*s* and 106*s* in the direction counter to the rotary direction of the tool cooperate with successive supporting surface sections 108*s* and 110*s* in the direction counter to the rotary direction of the anvil roller 70.

The cooperating supporting ring sections 104*s*, 106*s* and supporting surface sections 108*s* and 110*s* take up a total load pressure A with which the rotating cutting tool 80 bears on the anvil roller 70 and which is a part of the biasing force V comprised in that force.

However the biasing force V leads not only to the formation of load pressure A acting on the anvil roller 70 via supporting rings 100 and 102 but also to a cutting force S, which is connected to an effective cutting length in the particular cutter section 92*s*.

Figure 4:
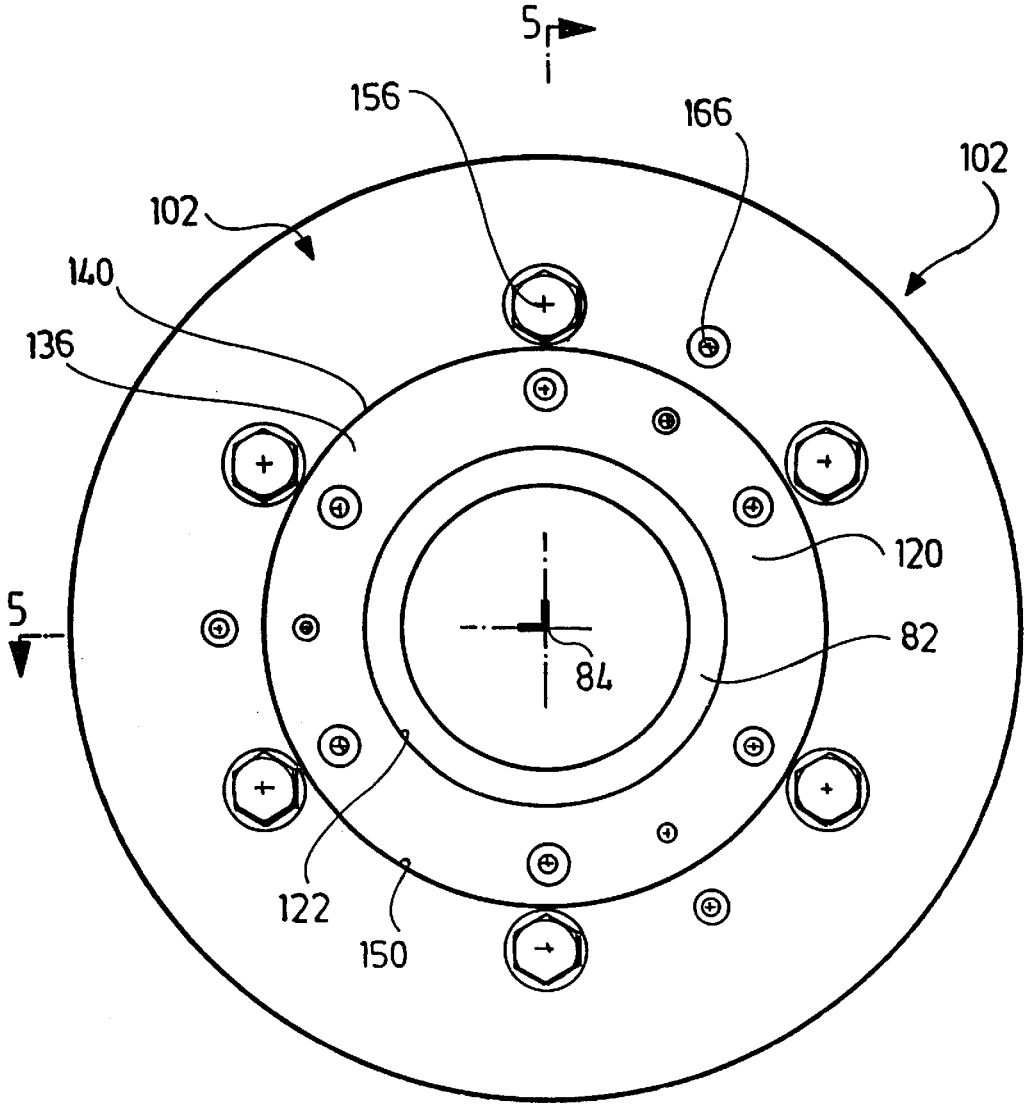
FIG. 4 is a plan view of a cutting tool in the direction of arrow A in FIG. 2.

As shown in FIG. 4 taking the supporting ring 102 as an example, each supporting ring 100, 102 is seated on an expansion member 120 which engages round the respective tool shaft 82, 86 in the form of an expansion member ring and which has a load pressure surface 122 associated with and seated on a peripheral surface 124 of the respective tool shaft 82, 84, the expansion member being supported thereby radially of the rotary axis 84.

The expansion member 120 further has an annular surface 126 facing towards the cutting tool 80 and lying against an end face 130 of a cylindrical base member 132 of the cutting tool 80, the member 120 is preferably fixed against the end face 130 by tensioning elements 134 e.g. in the form of screws and is thus fixed non-positively to the end face 130 by the annular surface 126.

Relative to the rotary axis 84 the expansion member preferably has a radius smaller than a radius of the base member 132 of the cutting tool 80.

The expansion member 120 further has an outer conical surface 140 extending at a small conus angle to the rotary axis 84; the conus angle of the outer conical surface 140 may for example have a conus ratio of 1:10.

The shape of the conical surface 140 is such that it starts from an external annular surface 136 of the expansion member 120 facing away from the base member 132 and widens out towards the annular surface 126 facing towards the base member 132, that is to say, an outer radius of the external annular surface 136 is smaller than an outer radius of the internal annular surface 126, provided that both annular surfaces 126, 136 extend from the load pressure surface 122 extending cylindrically of the rotary axis 84, in a radial direction and perpendicular to the axis 84 as far as the external tapering surface 140.

Figure 5:
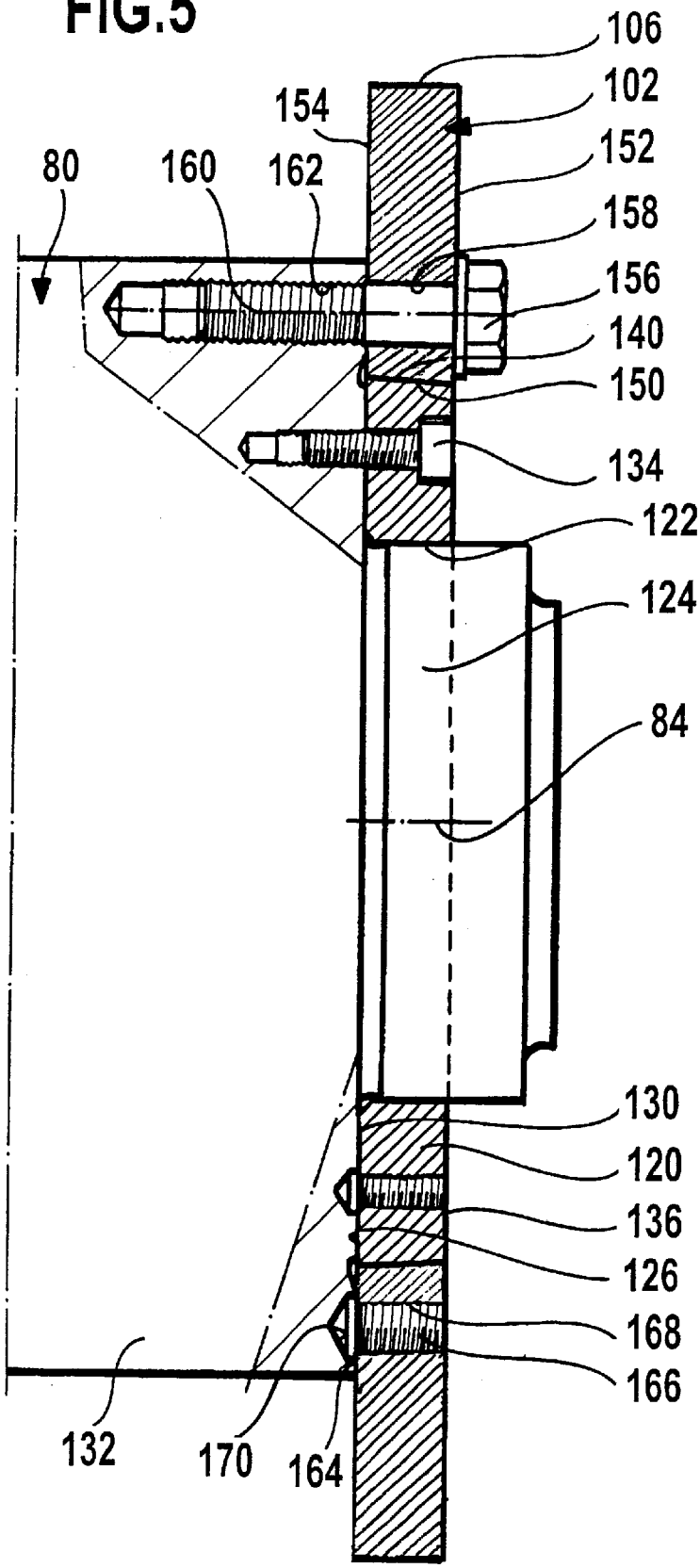
FIG. 5 is a section taken along line 5—5 in FIG. 4 with the supporting ring expanded to the maximum.

The respective supporting ring, ring 102 in FIGS. 4 and 5, itself has an internal conical surface 150 at a side opposite the supporting ring surface 106; the surface 150 runs conically to an axis of the supporting ring 102, which coincides with the rotary axis 84 in the state mounted on the cutting tool 80, and has the same conus ratio as the external conical surface 140.

The internal conical surface 150 similarly extends over the whole width of supporting ring 102, i.e. from an external annular surface 152 thereof to an annular surface 154 of the ring 102 at least partially facing towards the end face 130 of the base member 132 of the cutting tool 80.

The radius of the internal conical surface in a plane defined by the external annular surface 152 and extending perpendicular to the rotary axis 84 is smaller than the radius of the internal conical surface 150 in a plane defined by the annular surface 154 and extending perpendicular to the axis 84.

Clamping elements 156 are likewise provided to fix the respective supporting ring 100, 102, e.g. ring 102 in FIGS. 4 and 5; these elements may e.g. be screws which each pass through an opening 158 in the supporting ring 102 and have their threaded sections 160 screwed into tapped holes in the base member 132, the holes starting from the end face 130 perpendicular to the rotary axis 84 and extending into the base member 132 preferably parallel with the axis 84.

The clamping elements 156 may be clamped on strongly enough to enable the particular supporting ring, i.e. ring 102 in this case, to have an internal part 164 of the annular surface 154 applied to the end face 130 and thus supported against that face.

The internal conical surface 150 of the respective supporting ring, in this case ring 102, is dimensioned so that, when the ring 102 is placed on the expansion member 120 and moved parallel with the rotary axis 84 towards the end face 130, the material of the ring 102 is expanded in a radial direction and the whole ring is thus expanded radially of the rotary axis 84; the radial expansion of the supporting ring 102 is below the elastic expansion limit, which is dependent on the ring material, and is e.g. less than 0.1% of the ring diameter.

Maximum expansion of the supporting ring 102 is e.g. at a value of less than 80% of the elastic expansion limit, and is used when the cutter 92 is new and unworn. When a web of material 90 is cut for a certain period with an initially new cutter 92 in the cutting tool 80, the cutter 92 becomes worn and the distance to which it extends radially from the rotary axis 84 is thus reduced by some hundredths of a millimeter, this reduction is however enough to make the cutting action of the cutter 92 inadequate for sensitive webs of material 90.

In that case, in the cutting machine according to the invention, the radial expansion of the supporting ring 102 may be reduced by moving the ring 102 slightly away from the end face 130 of the base member 132 of the cutting tool 80, and thus sliding the internal tapering surface 150 over the external tapering surface 140 parallel with the rotary axis 84, thereby reducing the expansion of the ring 102 by some hundredths of a millimeter.

Figure 6:
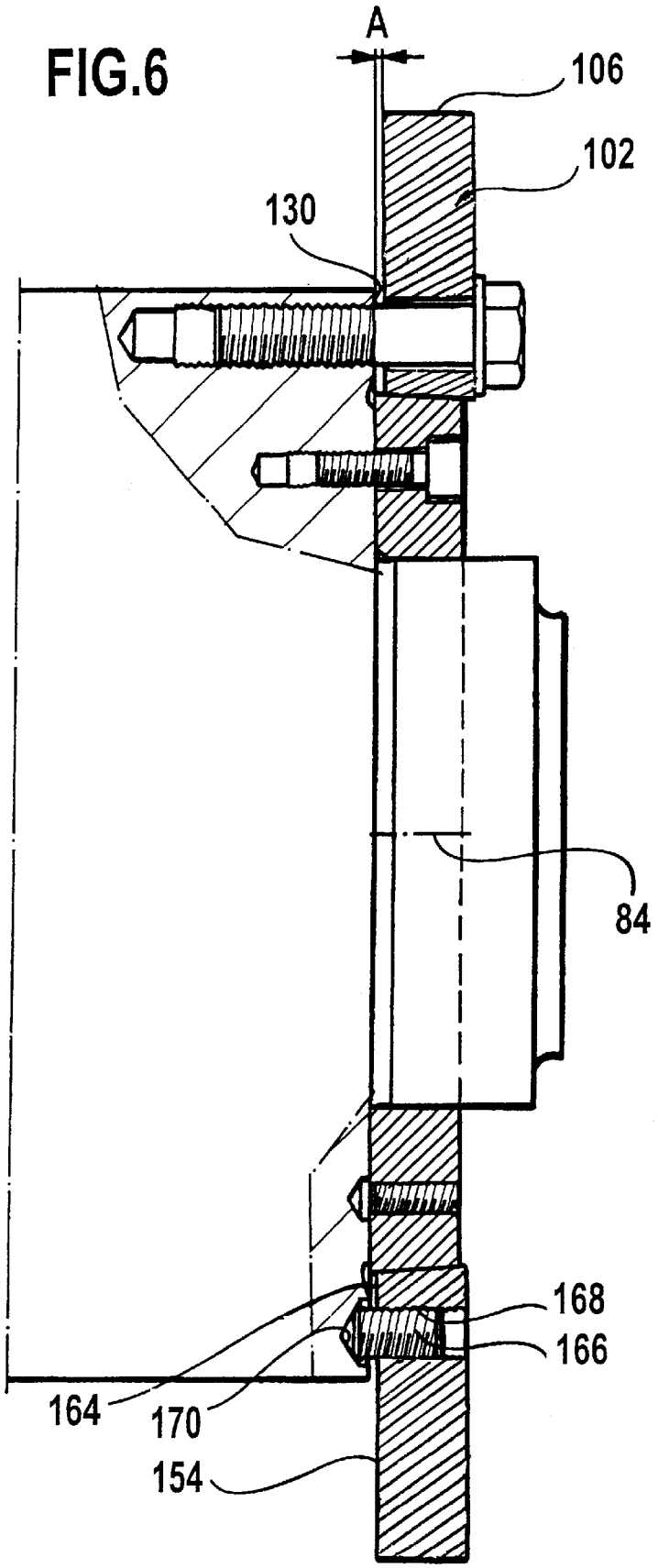
FIG. 6 is a section similar to FIG. 5 with the expansion of the supporting ring reduced by moving it away from an end face of the cutting tool.

For this purpose the clamping elements 156 are first released. As a simple way of moving the supporting ring 102 away from the end face 130 however, pressure elements 166, e.g. in the form of screws, are inserted in the clamping elements; the screws engage in tappings 168 in the supporting ring 102 and, when tightened, act against an indentation 170 in the end face 130 which acts as a thrust bearing for the screws, thus enabling the part 164 of the annular surface 154 of the ring 102 to be positioned a distance A away from the end face 130 as shown in FIG. 6; as the ring 102 has been expanded only within a range below the elastic expansion limit, as already described, when the annular surface part 164 of the ring 102 is moved away from the end face 130, the ring 102 contracts radially of the rotary axis 84 as permitted by the wedge angle of the conical surfaces 140 and 150, and the diameter of the supporting ring surface 106 is reduced.

Figure 7:
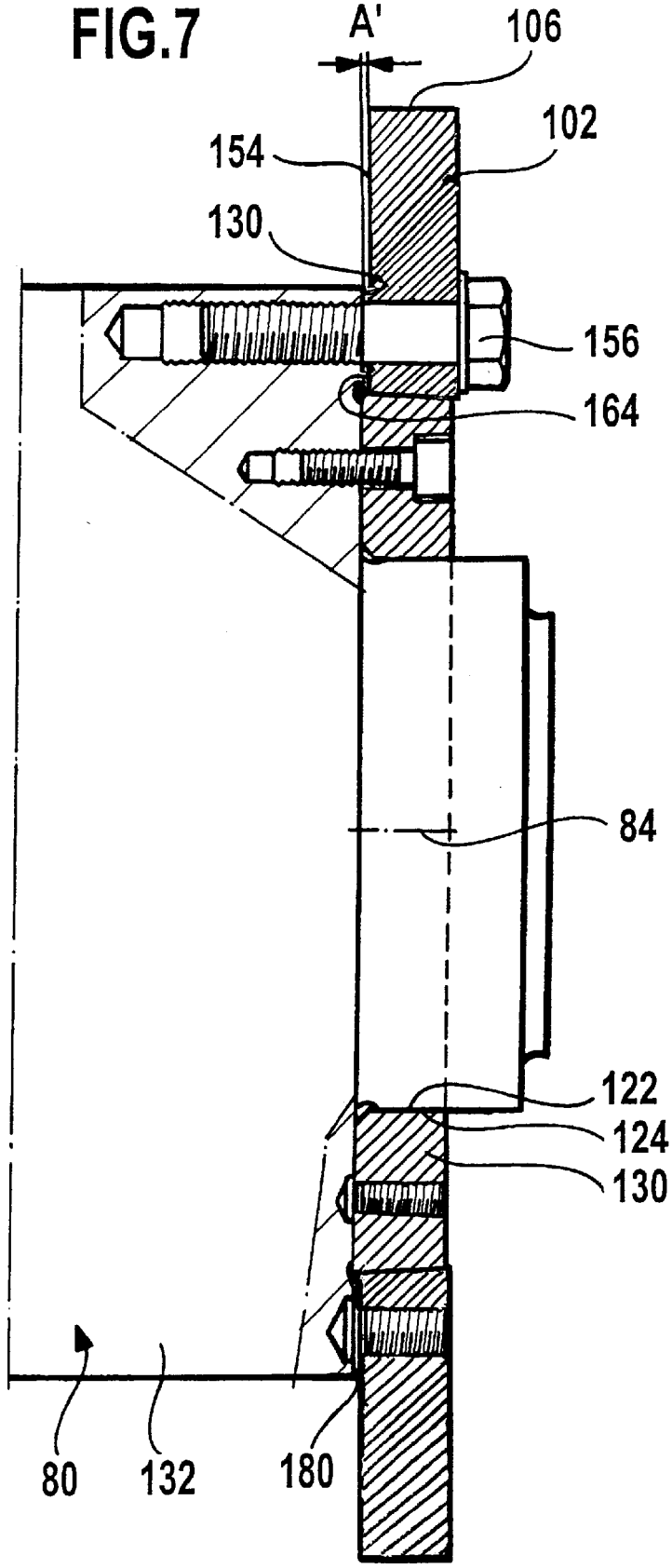
FIG. 7 is a section similar to FIG. 5 with the expansion of the supporting ring reduced, and with the ring simultaneously fixed to the end face of the cutting tool by a distance element.

In order to pre-define the reduction in the diameter of the supporting ring 102, distance elements 180 of a thickness A', e.g. in the form of pieces of foil or possibly an encircling foil ring, are inserted between the part 164 of the annular surface 154 of the ring 102 and the end face 130 as shown in FIG. 7; then the ring 102 is again clamped to the base member 132 so that the annular surface part 164 is braced against the distance element 180, which is in turn clamped against the end face 130 again, and thus by means of the distance element 180 the supporting ring 102 is stabilized again by the end face 130 and the annular surface part 164, which is supported against the end face by the distance element 180; even when the diameter of supporting ring area 106 is reduced, the stability of the ring 102 is consequently the same as at maximum stretching of the ring 102 with annular surface part 164 directly in contact with the end face 130.

According to the thickness A' of distance elements 180, successive insertion of a plurality of these elements enables the diameter of the surface 106 of the supporting ring 102 to be reduced and adapted to the wear on the cutter 92.

In accordance with the invention the internal conical surface 150 is always dimensioned relative to the external conical surface 140 in such a way that, even when a minimum diameter of the supporting ring surface 106 is envisaged, the supporting ring 102 itself is expanded radially of the rotary axis 84 by the internal conical surface 150 and the external conical surface 140; consequently the internal conical surface 150 is always seated on the external conical surface 140 with tension, in order to avoid any radial flexibility of the supporting ring 102 owing to its support by the expansion member 120.

What is claimed is:

1. A cutting machine comprising:

a machine frame, an anvil roller rotatably mounted on the machine frame about a rotary axis and having an anvil surface, a cutting tool mounted on the machine frame for rotation about a rotary axis, a cutter interacting with the anvil surface, supporting rings which are held on the cutting tool and support the cutting tool relative to the anvil roller with their supporting ring surfaces and/or vice versa, and interacting wedge surfaces for adjusting the diameter of each supporting ring.

2. A cutting machine comprising a machine frame, an anvil roller rotatably mounted on the machine frame about a rotary axis and having an anvil surface, a cutting tool mounted on the machine frame for rotation about a rotary axis, with a cutter interacting with the anvil surface and with supporting rings which are held on the cutting tool and support the cutting tool relative to the anvil roller with their supporting ring surfaces and/or vice versa, wherein the diameter at the surface of each supporting ring is adjustable by radial expansion and contraction of the supporting ring by means of a manual mechanical adjustment, to compensate for wear of the cutter by varying the distance of the cutter from the anvil surface.

3. A cutting machine according to claim 2, wherein the mechanical adjustment comprises interacting wedge surfaces which are adjustable in their position relative to each other.

4. A cutting machine according to claim 3, wherein at least one of the wedge surfaces is in the form of a conical surface relative to the rotary axis.

5. A cutting machine according to claim 4, wherein each wedge surface is in the form of a conical surface relative to the rotary axis.

6. A cutting machine according to claim 4, wherein one of the wedge surfaces is an internal wedge surface and the other is a corresponding external wedge surface, which are movable relative to each other in a direction parallel with the rotary axis.

7. A cutting machine according to claim 5, wherein an internal wedge surface is arranged on a radially expansible element carrying it.

8. A cutting machine according to claim 7, wherein in all diameter adjustments of the supporting ring surfaces, the internal wedge surface is seated on the external wedge surface with elastic expansion of the element carrying the surface.

9. A cutting machine according to claim 8, wherein the external wedge surface is provided on an expansion member arranged on the cutting tool.

10. A cutting machine according to claim 9, wherein the radially expansible element carrying the internal wedge surface and the expansion member are movable relative to each other in the direction of the rotary axis.

11. A cutting machine according to claim 9, wherein the radially expansible element carrying the internal wedge surface and the expansion member are fixable in their various positions relative to each other on the cutting tool or on the anvil roller.

12. A cutting machine according to claim 11, wherein the radially expansible element and the expansion member are positionable in a different distance from an end face of the cutting tool or the anvil roller.

13. A cutting machine according to claim 12, wherein the radially expansible element or the expansion member is positionable by a distance element in different distances from the end face of the cutting tool or the anvil roller.

14. A cutting machine according to claim 7, wherein the radially expansible element is the supporting ring itself.

15. A cutting machine according to claim 6, wherein the external wedge surface is arranged on a central expansion member.

16. A cutting machine according to claim 2, wherein the supporting ring is braceable against an end face of the cutting tool or of the anvil roller.

17. A cutting machine according to claim 14, wherein the supporting ring is positionable against the cutting tool with an adjustable distance from the end face of the cutting tool or anvil roller according to an elastic expansion state.

18. A cutting machine according to claim 17, wherein the supporting ring is positionable in different distances from the end face by distance elements.

19. A cutting tool rotatable about a rotary axis, with a cutter which interacts with an anvil surface of an anvil roller rotatable about a rotary axis, and with supporting rings which extend from and are held to the cutting tool and support it relative to the anvil roller on supporting ring surfaces, wherein for each supporting ring the diameter at the supporting ring surface is adjustable by radial expansion or contraction of the supporting ring by means of an expansion device, in order to change the extension of the supporting rings from the cutting tool with respect to the cutter.

20. An anvil roller rotatable about a rotary axis, comprising an anvil surface which interacts with a cutter of a cutting tool rotatable about a rotary axis, and further comprising supporting rings which are held to the anvil roller and support it relative to the cutting tool on supporting ring surfaces, wherein for each supporting ring the diameter at the supporting ring surface is adjustable by radial expansion or contraction of the supporting ring by means of an expansion device, in order to change the extension of the supporting rings from the anvil surface.

* * * * *